United States Patent [19]

Mizude et al.

[11] Patent Number: 4,804,997

[45] Date of Patent: Feb. 14, 1989

[54] SPECIFIC CASSETTE SELECTION APPARATUS

[75] Inventors: Kazuhiro Mizude, Toyonaka; Hideyuki Ujihira, Sakai, both of Japan

[73] Assignee: Mita Industrial Co., Ltd., Osaka, Japan

[21] Appl. No.: 28,649

[22] Filed: Mar. 20, 1987

[30] Foreign Application Priority Data

Mar. 27, 1986 [JP] Japan ..... 61-69599

[51] Int. Cl.[4] ..... G03G 15/00; G03G 21/00

[52] U.S. Cl. ..... 355/14 SH; 271/9; 355/3 SH; 355/25

[58] Field of Search ..... 355/3 R, 3 SH, 14 SH, 355/25; 271/9

[56] References Cited

U.S. PATENT DOCUMENTS 4,406,537 9/1973 Mori ..... 355/14 SH
4,530,593 7/1985 Kasuya et al. ..... 355/14 R
4,568,173 2/1986 Abuyama ..... 355/14 R
4,659,207 4/1987 Maekawa ..... 355/3 R X
4,666,289 5/1987 Kawano ..... 355/14 SH X
4,669,858 6/1987 Ito et al. ..... 355/14 SH X

FOREIGN PATENT DOCUMENTS 0121906 10/1984 European Pat. Off. .
0121933 10/1984 European Pat. Off. .
0180984 5/1986 European Pat. Off. .

*Primary Examiner*—Fred L. Braun
*Attorney, Agent, or Firm*—Antonelli, Terry & Wands

[57] ABSTRACT

A specific cassette selection apparatus for use with a copying machine having a plurality of removable paper feeding cassettes. The apparatus includes an identification device, a specific copying mode selection device, and a paper feeding cassette selection device. The cassette selection device responds to paper-size identification signals from the identification device and a copying mode selection signal from the mode selection device to select a cassette for use in a selected copying mode. When either a two-sided copying mode or a continuous copying mode is selected, the paper feeding cassette selection device selects a specific paper feeding cassette containing copying paper of only a specific paper size associated with the two-sided copying and/or the continuous copying modes.

6 Claims, 5 Drawing Sheets

HIGHEST STAGE
INTERMEDIATE STAGE
LOWEST STAGE
63
A3
A4
B4
B5
A4 R
Folio
11×15
73
62

61
73
62

HIGHEST STAGE
INTERMEDIATE STAGE
LOWEST STAGE
63
A3
A4
B4
B5
A4 R
Folio
11×15
73
62

SPECIFIC CASSETTE SELECTION APPARATUS

BACKGROUND OF THE INVENTION

The present invention relates to a specific cassette selection apparatus, and more particularly to an apparatus capable of automatically selecting, from a plurality of paper feeding cassettes, a proper cassette for paper of the size which can be used for a specific function such as a continuous page copying function, an automatic both-side copying function, etc. when such function is selected.

Recently, the demand for a multi-function copying machine has become strong. As a part of such demand, there has been proposed a copying machine provided with a continuous page copying function capable of continuously copying each page of a book document without movement of the book document, or an automatic both-side copying function capable of automatically copying images on both sides of a piece of paper without manual paper removal and insertion.

Such copying machine is usually provided with a continuous page copying mode selection key or an automatic both-side copying mode selection key. However, a paper feeding cassette to be used in a selected mode has to be selected by operating a cassette selection key and such cassette selection operation has to be made independently of the mode selection operation. Therefore, after a mode selection key has been operated, the cassette selection key is operated to select a proper paper feeding cassette and the print key is then operated to carry out the continuous page copying function or the automatic both-side copying function properly.

As to a copying machine having a continuous page copying function, there has been proposed a machine in which the continuous page copying function can be fulfilled with paper of a size of 8.5 inches ×11 inches only. In such machine, the mode selection key is operated to select the continuous page copying mode, and the cassette selection key is operated to select the cassette holding 8.5 inches ×11 inches size paper. The print key is then operated to carry out the continuous page copying operation.

In the aforementioned copying machine, although certain restrictions are imposed on the size of paper which can be used for the continuous page copying function or the automatic both-side copying function, the print key can be operated regardless of the size of the paper selected. Therefore, an erroneous selection of a paper feeding cassette results in an erroneous copy. Further, when a proper paper feeding cassette has not been selected after the aforementioned function was selected, it is required to select a proper cassette by operating the cassette selection key.

In the latter copying machine mentioned above, the occurrence of an erroneous copy can be prevented when the continuous page copying mode is selected. However, selection of a proper cassette is always required.

SUMMARY OF THE INVENTION

It is an object of the present invention to provide a specific cassette selection apparatus capable of performing a specific copying opertion without producing an erroneous copy.

It is another object of the present invention to provide a specific cassette selection apparatus which does not require selection of a proper paper feeding cassette for a specific copying operation.

The specific cassette selection apparatus in accordance with the present invention comprises identification means, specific copying mode selection means and paper feeding cassette selection means.

The identification means is provided for identifying the size of paper housed in each paper feeding cassette. The specific copying mode selection means is provided for selecting a state in which a specific copying operation can be performed. The paper feeding cassette selection means is provided for selecting a proper cassette for paper of the size which can be used for carrying out a specific copying operation, based on signals supplied from the specific copying mode selection means and the identification means.

The paper feeding cassette selection means can be so arranged as to display a paper feeding cassette to be properly selected, if such cassette has not been set.

The specific copying operation may be a continuous page copying operation or an automatic both-side copying operation.

According to the specific cassette selection apparatus arranged as mentioned above, the identification means identifies the size of the paper housed in each paper feeding cassette. Thus when the state in which the specific copying operation can be performed is selected by operating the specific copying mode selection means, the paper feeding cassette selection means can select a proper cassette containing paper of the size which can be used for carrying out such specific copying operation, based on signals supplied from the specific copying mode selection means and the identification means.

Preferably, the paper feeding cassette selection means includes means to display the required specific paper feeding cassette if such cassette has not been mounted to the copying machine. Such display means indicates the proper cassette to be mounted by displaying such cassette.

DESCRIPTION OF THE PREFERRED EMBODIMENTS

Figure 4:
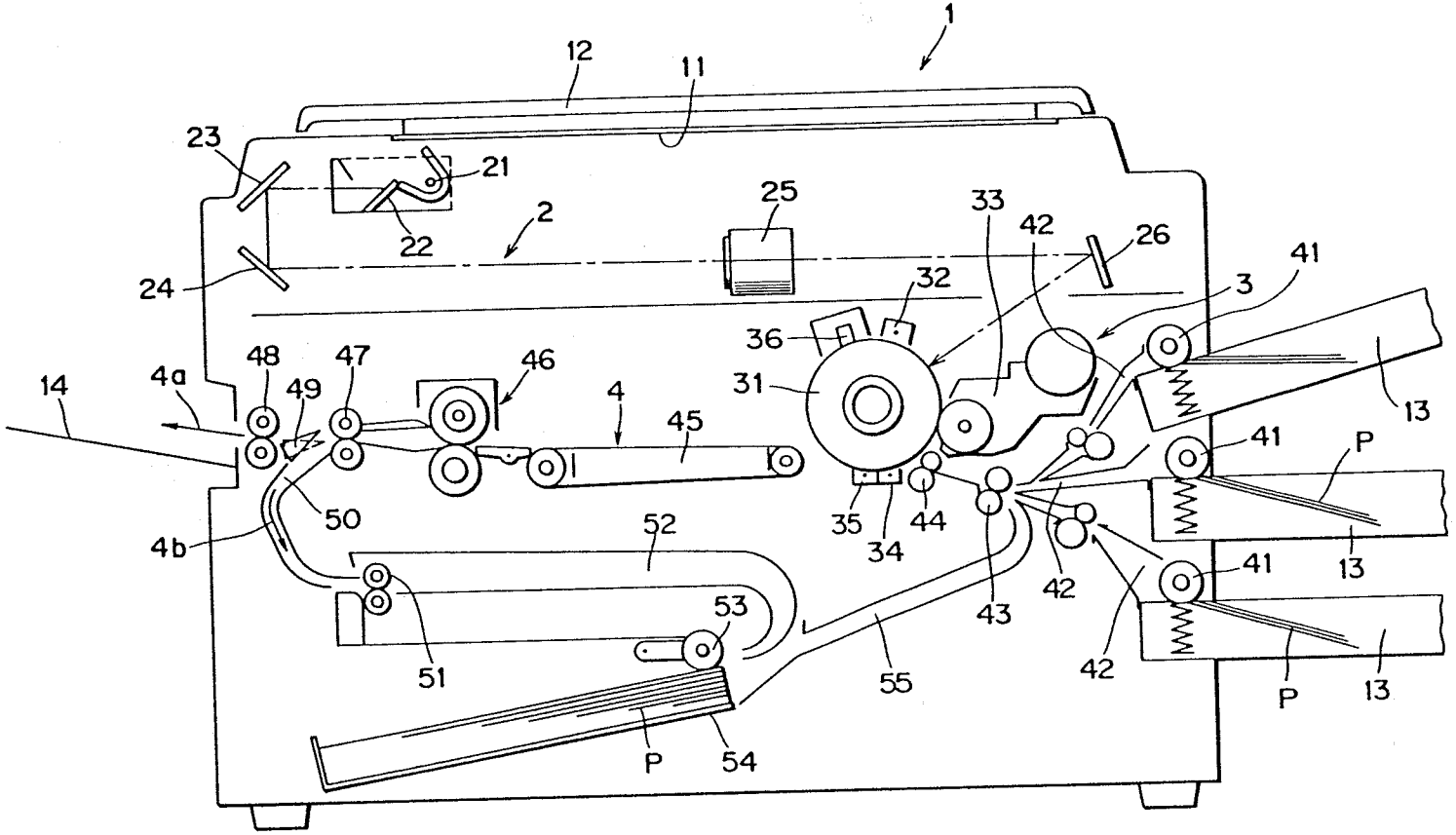
FIG. 4 is a schematic view showing the inner mechanism of a copying machine having an automatic both-side copying function.

FIG. 4 is a schematic view showing the inner mechanism of a copying machine having an automatic both-side copying function. A copying machine body 1 is provided at the top thereof with a contact glass 11 and an original cover 12 and in the inside thereof with an optical system 2, a copy treatment section 3 and a conveying section 4.

The optical system 2 has a light source 21, mirrors 22, 23, 24, a lens 25 and a mirror 26. The light source 21 illuminates an original document (not shown) placed on the contact glass 11. The light reflected from the original document is guided to the copy treatment section 3 through the mirrors 22, 23, 24, the lens 25 and the mirror 26.

In the copy treatment section 3, a photoreceptor drum 31, rotatable in one direction, is surrounded by a charger 32, a developing device 33, a transfer charger 34, a separation charger 35 and a cleaner 36 in this order. On the surface of the photoreceptor drum 31 which is uniformly charged by the charger 32, a static latent image corresponding to the image of the original document is formed by guiding the light reflected from the original document onto said surface. The static latent image is then developed into a toner image by the developing device 33. The transfer charger 34 then transfers the toner image to a copying paper P. After the separation charger 35 has peeled the copying paper P from the surface of the photoreceptor drum 31, the toner remaining on the surface of the photoreceptor drum 31 is collected by the cleaner 36.

The conveying section 4 comprises a normal paper conveying unit 4*a* which includes paper feeding rollers 41 for feeding copying paper P sheet by sheet from each of paper feeding cassettes 13 which are removably mounted on the copying machine body 1 at predetermined positions as shown. The conveying section 4 further has paper feeding passages 42, resist rollers 43, conveying rollers 44, a conveying belt 45, a heat-fixation device 46, conveying rollers 47 and paper discharging rollers 48, and a feedback paper conveying unit 4*b* which includes a changeover pawl 49 between the conveying rollers 47 and the discharging rollers 48, a first guide space 50 in a curved form, conveying rollers 51, a second guide space 52, a secondary paper feeding roller 53, an intermediate tray 54 and a paper feeding passage 55.

When only one image forming operation is to be performed on a piece of paper P, paper conveyance is carried out by the paper conveying unit 4*a* alone. When two or more image forming operations are to be performed on a piece of paper P, paper conveyance is alternately carried out by the paper conveying units 4*a* and 4*b*.

Figure 1:
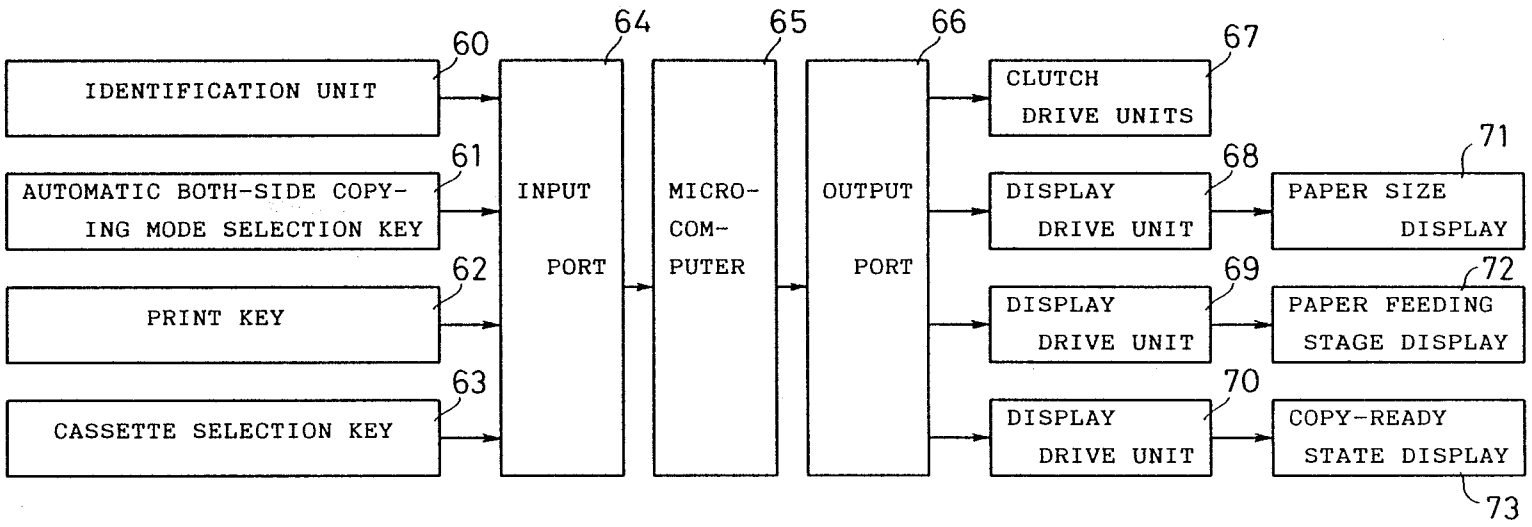
FIG. 1 is a block diagram showing an embodiment of specific cassette selection apparatus in accordance with the present invention.

FIG. 1 is a block diagram of an embodiment of a specific cassette selection apparatus in accordance with the present invention. An identification unit 60 which identifies the size of paper held in a mounted paper feeding cassette (which unit is constituted, for example, by a magnet and a read switch, the relative positions of which are set according to the types of paper feeding cassettes), an automatic both-side copying mode selection key 61, a print key 62, and a cassette selection key 63 are connected to a microcomputer 65 through an input port 64. A control signal from the microcomputer 65 is supplied, through an output port 66, to clutch drive units 67 for controlling the drive of the respective paper feeding rollers 41, and display drive units 68, 69, 70. Output signals from the display drive units 68, 69, 70 are respectively supplied to a paper size display 71, a paper feeding stage display 72 and a copy-ready state display 73.

Figure 2:
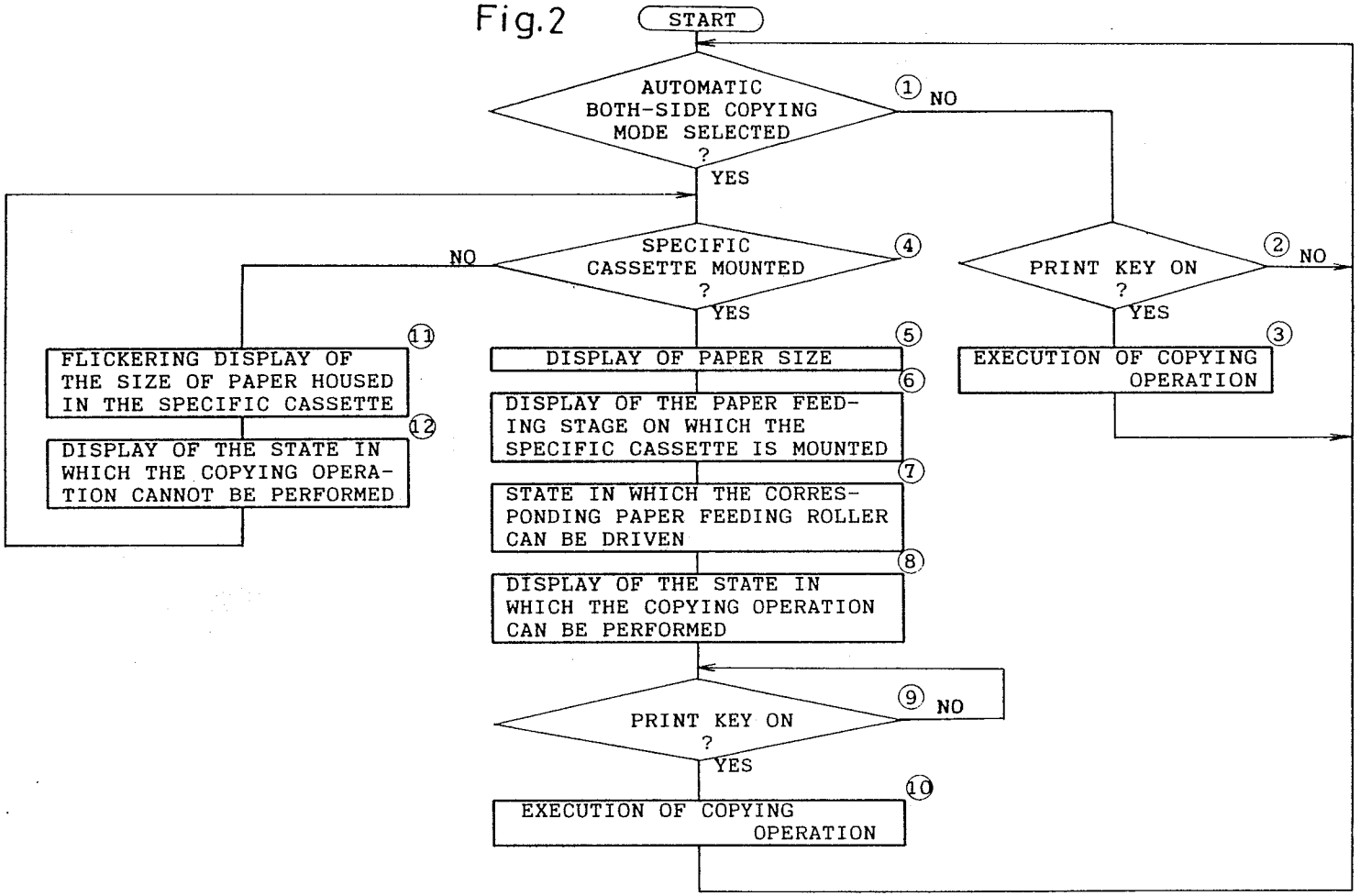
FIG. 2 is a flowchart for a specific cassette selection operatin.

FIG. 2 is a flowchart illustrating the operation of the specific cassette selection apparatus.

At the step (1), it is judged whether or not the automatic two-side or both-side copying mode has been selected, that is, whether or not the automatic both-side copying mode selection key 61 has been operated.

When it is judged at the step (1) that the automatic both-side copying mode has not been selected, the judgment at the step (1) is repeated until it is judged at the step (2) that the print key 62 has been operated. When it is judged at the step (2) that the print key 62 has been operated, paper is fed from a paper feeding cassette selected at this point and a series of copying operations are carried out at the step (3). Then, the judgments and processes beginning at and continuing after the step (1) are repeated.

When it is judged at the step (1) that the automatic both-side copying mode has been selected, it is judged, based on a signal from the identification unit 60, at the step (4) whether or not there is mounted a paper feeding cassette for paper of the size which can be used in the automatic both-side copying mode (hereinafter referred to as a specific cassette). When it is judged that the specific cassette has been mounted, the paper size display 71 displays the size of paper housed in the specific cassette at the step (5). At the step (6), the feeding paper stage display 72 displays the paper feeding stage on which the specific cassette is mounted. At the step (7), the corresponding clutch drive unit 67 is ready to transmit a driving force to the corresponding paper feeding roller for the paper feeding stage on which the specific cassette is mounted. At the step (8), the copy-ready state display 73 displays a copy-ready state. At the step (9), the apparatus waits until the print key 62 is operated and at the step (10), a series of automatic both-side copying operations are carried out. Then, the judgments and processes beginning at and continuing after the step (1) are repeated.

When it is judged at the step (4) that the specific cassette has not been mounted, the paper size display 71 flickeringly i.e. intermittently displays the size of paper housed in the specific cassette at the step (11). At the step (12), the copy-ready state display 73 displays a copy-impossible state. Then, the judgments and processes beginning at and continuing after the step (4) are repeated.

Figures 3A, 3B, 3C:
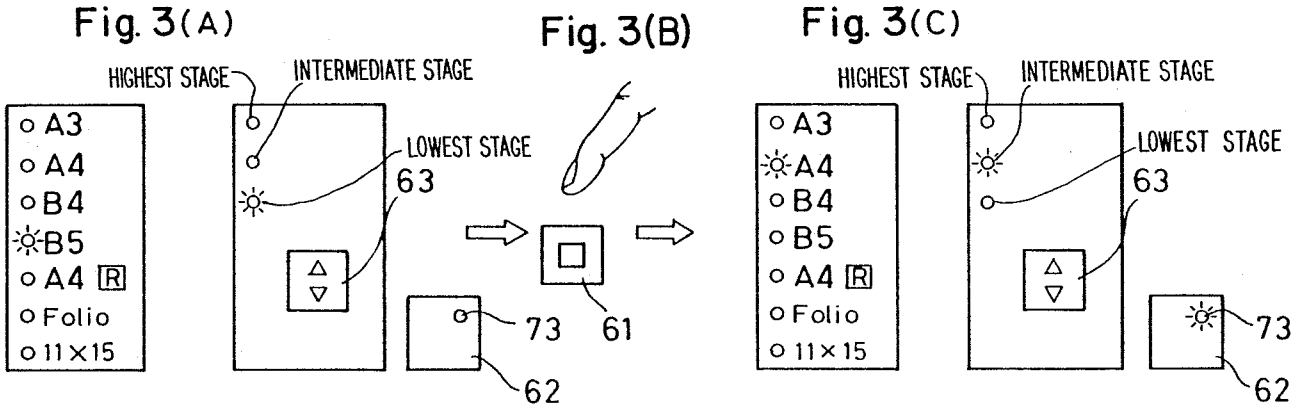
FIGS. 3(A), 3(B), and 3(C) are useful in understanding a specific cassette selection operation.

In brief, when the automatic both-side copying mode is selected (FIG. 3-B), with the specific cassette mounted on any of the paper feeding stages (for example, as shown in FIG. 3-A in which the paper feeding cassette for paper of B5 size is selected and mounted on the lowest stage), the specific cassette is automatically selected and the specific cassette selection state is displayed as shown in FIG. 3-C for example, in which the specific cassette for paper of A4 size is selected and mounted on the intermediate stage. The copy-ready state is displayed as shown in FIG. 3-C in which a copy ready lamp 73 in the print key 62 comes on.

When the specific cassette is not mounted on any of the paper feeding stages, the size of the paper housed in the specific cassette is intermittently displayed and the copy-ready lamp 73 extinguishes to inform the operator that the specific cassette should be mounted.

Accordingly, when the specific cassette is mounted, the corresponding paper feeding stage is automatically selected, and when the specific cassette is not mounted, the copying operation cannot be carried out. This not only prevents the occurrence of an erroneous copy, but also eliminates the cassette selection operation when the specific cassette has been mounted.

The following description will discuss the operation of the copying machine having the above-described construction.

[I] When one image forming operation is to be performed on a piece of paper P:

In such case, the changeover pawl 49 is operated to guide the paper P sent from the conveying rollers 47 to the discharging rollers 48. On the paper P sent from a paper feeding cassette 13, there is formed a toner image corresponding to the image of an original document by the copy treatment section 3. The paper P passes through the heat-fixation device 46 to heat and fix the toner image. By the discharging rollers 48, the paper P is then discharged to a receiving plate 14 attached to the copying machine body 1 at a predetermined position thereon.

[II] When two or more image forming operations are to be performed on a piece of paper P:

In such case, the changeover pawl 49 is operated to guide the paper P sent from the conveying rollers 47 to the first guide space 50. A toner image is formed on the paper P sent from a paper feeding cassette 13, and then the toner image is heated and fixed. Thereafter, the paper P is guided to the first guide space 50 by the conveying rollers 47 and the changeover pawl 49 and then continuously conveyed until the tip of the paper P is guided between the conveying rollers 51.

In such state, conveying forces are respectively applied to the paper P by the conveying rollers 47 and the conveying rollers 51. Since the conveying speed of the conveying rollers 47 is equal to or higher than the conveying speed of the conveying rollers 51, no tension is applied to the paper P. The paper P therefore passes through the first guide space 50 in a relatively free condition and is guided to the intermediate tray 54 through the second guide space 52.

The paper P guided in the intermediate tray 54 is turned upside down because of the configuration of the second guide space 52.

The secondary paper feeding roller 53 lets out the paper P, which passes through the paper feeding passage 55 and is guided again to the copy treatment section 3. A toner image is formed on the reverse side of the paper P. With the toner image heated and fixed by the heat-fixation device 46, the paper P is conveyed by the conveying rollers 47. The position of the changeover pawl 49 is changed to guide the paper P to the discharging rollers 48, which discharge the same to the receiving plate 14.

The changeover pawl 49 is driven so as to be in a position for guiding the paper P to the discharging rollers 48, at a predetermined time before the paper P is guided again to the changeover pawl 49, after the paper P has been entirely guided to the first guide space 50.

As apparent from the foregoing, when there is selected the automatic both-side copying mode requiring the use of a specific cassette, it is detected that the specific cassette for paper which can be used in the automatic both-side copying operation is mounted on any of the paper feeding stages, and then the specific cassette is automatically selected. This prevents the occurrence of an erroneous copy and eliminates the specific cassette selection operation, thus improving the manipulation.

Figure 5:
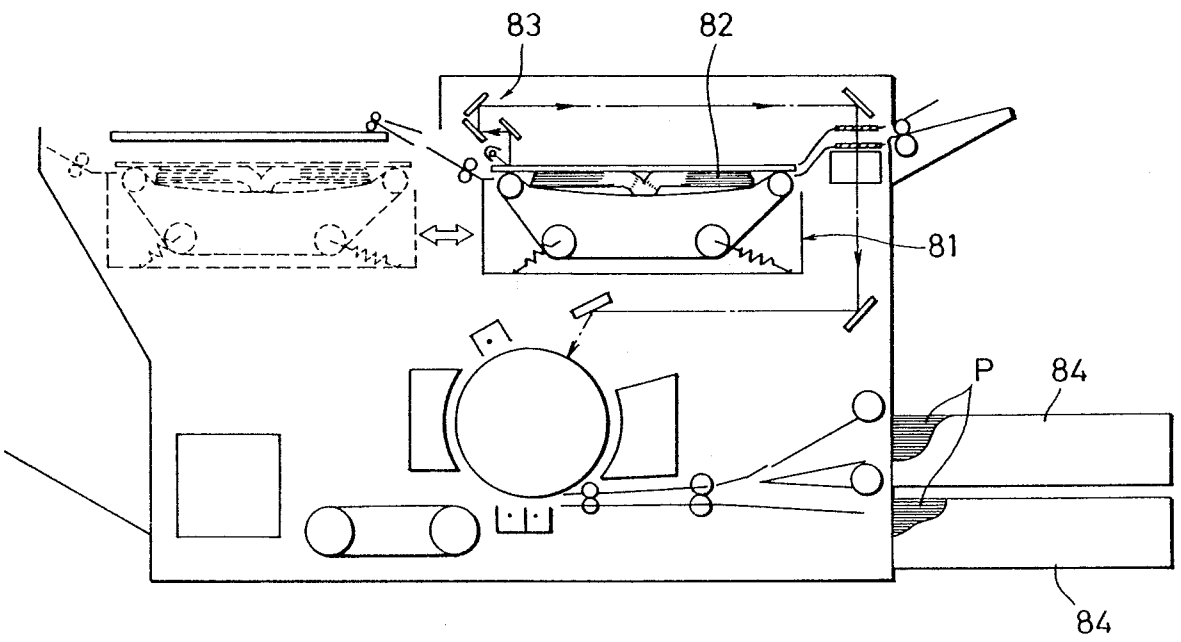
FIG. 5 is a schematic view showing the inner mechanism of a copying machine having a continuous page copying function.

The present invention should not be limited to the embodiment discussed hereinbefore, but can be applied to, for example, a copying machine having a continuous page copying function. Such copying machine is schematically shown in FIG. 5 in which a book document 82, facing upwardly, is set on a document placing base 81 having a main part of an endless belt, the document placing base 81 is reciprocally movable between the exposure position and the setting position. An optical system 83 illuminates the book document in the course of the reciprocal motion of the document placing base 81 so that a copied image is formed on paper P sent from a paper feeding cassette 84.

In addition, the state in which the specific cassette is not mounted can be displayed by a special display device. Other modifications and variations of the present invention are possible without departing from the spirit of the invention.

What is claimed is:

1. A specific cassette selection apparatus for a copying machine capable of forming a copied image of an original document on copying paper fed from a paper feeding cassette selected from a plurality of paper feeding cassettes removably mounted on the body of the copying machine, said specific cassette selection apparatus comprising:

identification means for identifying the size of paper contained in each of said paper feeding cassettes and providing paper-size identification signals indicative thereof;

specific copying mode selection means for enabling selection of a copying mode selected from a plurality of copying modes, including an automatic two-sided copying mode, and for providing a copying mode selection signal indicative of the selected copying mode; and paper feeding cassette selection means, responsive to the paper-size identification signals and the copying mode selection signal, for selecting from among the plurality of paper feeding cassettes on the copying machine a cassette containing copying paper for use in copying in the selected copying mode, said paper feeding cassette selection means selecting only a specific paper feeding cassette containing copying paper of only a specific paper size for use in copying in said automatic two-sided copying mode.

2. A specific cassette selection apparatus as set forth in claim 1, wherein said plurality of modes further include a continuous copying mode, said specific copying mode selection means enabling selection of said continuous copying mode and said paper feeding cassette selection means selecting only a specific paper feeding cassette containing paper of only a specific paper size for use in copying in said continuous copying mode.

3. A specific cassette selection apparatus as set forth in claim 2, wherein said paper feeding cassette selection means further comprises means for providing a display signal indicative of a specific paper feeding cassette whenever one of said two-sided copying or continuous copying modes is selected by said specific copying mode selection means and the specific paper feeding cassette associated with the selected two-sided copying or continuous copying mode is not mounted to the copying machine.

4. A specific cassette selection apparatus as set forth in claim 1, wherein said paper feeding cassette selection means further comprises means for providing a display signal indicative of the specific paper feeding cassette whenever said specific paper feeding cassette is not mounted to the copying machine.

5. A specific cassette selection apparatus for a copying machine capable of forming a copied image of an original document on copying paper fed from a paper feeding cassette selected from a plurality of paper feeding cassettes removably mounted on the body of the copying machine, said specific cassette selection apparatus comprising:

identification means for identifying the size of paper contained in each of said paper feeding cassettes and providing paper-size identification signals indicative thereof;

specific copying mode selection means for enabling selection of a copying mode selected from a plurality of copying modes, including a continuous copying mode, and for providing a copying mode selection signal indicative of the selected copying mode; and paper feeding cassette selection means, responsive to the paper-size identification signals and the copying mode selection signal, for selecting from among the plurality of paper feeding cassettes on the copying machine a cassette containing copying paper for use in copying in the selected copying mode, said paper feeding cassette selection means selecting only a specific paper feeding cassette containing copying paper of only a specific paper size for use in copying in said continuous copying mode.

6. A specific cassette selection apparatus as set forth in claim 5, wherein said paper feeding cassette selection means further comprises means for providing a display signal indicative of the specific paper feeding cassette whenever the specific paper feeding cassette is not mounted to the copying machine.

* * * * *